United States Patent [19]

Kuo-Ching et al.

[11] Patent Number: 4,694,866

[45] Date of Patent: Sep. 22, 1987

[54] SHEDDING DEVICE FOR A CIRCULAR WEAVING MACHINE

[76] Inventors: Huang Kuo-Ching, No. 43, Bao An Village, Ren Der, Shiang; Lin Yong-Hung, No. 5, Lane 140, Jong Jeng Rd. Gong How Villiage, Shin Gang Shiang, Jia Yih, both of Taiwan

[21] Appl. No.: 859,828

[22] Filed: May 5, 1986

[51] Int. Cl.[4] ..... D03D 37/00

[52] U.S. Cl. ..... 139/13 R

[58] Field of Search ..... 139/13 R, 14, 16, 17, 139/81

[56] References Cited

U.S. PATENT DOCUMENTS

| | | | |
|---|---|---|---|
| 2,353,387 | 7/1944 | Canney | 139/13 R |
| 2,811,986 | 11/1957 | Jacob et al. | 139/13 R |
| 3,128,795 | 4/1964 | Burnel | 139/13 R |

FOREIGN PATENT DOCUMENTS

| | | | |
|---|---|---|---|
| 506966 | 11/1951 | Belgium | 139/13 R |
| 766922 | 10/1971 | Belgium | 139/13 R |
| 383032 | 11/1932 | United Kingdom | 139/13 R |

*Primary Examiner*—Henry S. Jaudon

*Attorney, Agent, or Firm*—Angelo Notaro

[57] ABSTRACT

A shedding device for moving the shedding rods of a circular weaving machine includes a drive shaft which rotates a cam. The cam has a cam groove which lies in a horizontal plane and receives a plurality of cam follower supports. The supports are pivotally mounted near their center to a cantilever arm which is rotatably mounted about a vertical axis at a location spaced from the drive shaft. The cantilever arms hold the supports at correct angular positions with respect to the cam paths. Vertical swinging and pivoting of the follower supports are transmitted through horizontally moving control rods through cranks which convert the horizontal movement to vertical movement. Clamps are connected to the shedding rods and links connect the clamps to the cranks. A single follower can service a pair of connecting rods which in turn service a pair of shedding rods to save space around the cam.

6 Claims, 2 Drawing Figures

SHEDDING DEVICE FOR A CIRCULAR WEAVING MACHINE

FIELD AND BACKGROUND OF THE INVENTION

The present invention relates in general to circular weaving machines and, in particular, to a new and useful shedding device for such machines. The device of the invention utilizes a cam follower support which has cam means engaged in a rotating cam groove. The cam groove lies in a horizontal plane and, with its rotation, causes horizontal alternating movement of the cam follower support. Control rods are connected between the cam follower support and cranks. The cranks have arms which are connected to adjacent pairs of shedding rods of the circular weaving machine so that rotation of the cam groove causes reciprocal up and down movement of the shedding rods.

Circular weaving machines are different from other types of knitting machines which utilize hook needles to knit a fabric. Other knitting machines use a large number of hook needles which move alternately in a line. A circular weaving machine weaves a fabric utilizing horizontal yarns which are used in conjunction with the vertical yarns that are caused to make a shedding motion through which the vertical yarns pass. In other words, the horizontal yarns pass through loops of the vertical yarns when the vertical yarns are shed. The vertical yarns are shed by the motion of shedding rods. The vertical motion of the shedding rods is the same as the vertical motion needed for the vertical yarns.

In conventional circular weaving machines, the shedding rods each have a yarn guide (not shown) which guides a length of vertical yarn. The shedding rods are distributed in a circular path around the machine. Tappet rods are engaged with the shedding rods for moving the shedding rods up and down and, in turn, moving the lengths of yarn up and down. Several difficulties, however, have been discovered in such conventional circular weaving machines.

In a conventional circular weaving machine, a cam is provided with annular grooves. Each of the grooves receives a cam follower. The cam follower is located at one end of a lever arm. Each lever arm is pivotally mounted at a bearing post. Opposite ends of lever arms are connected to sliding guides or attachments 106 that are mounted on respective shedding rods. Cam is rotated by a motor and transmission means, to transmit an undulating path of cam grooves to the cam followers. This causes lever arms to pivot on bearing posts and transmit up and down movement to the shedding rods.

A shuttle for the horizontal yarns weaves the vertical yarns into a circular fabric which is drawn off the top of a circular weaving machine. Since a lever arm is provided for each of the shedding rods, the diameter of the circular fabric is limited by the number of shedding rods which can be distributed in a circle around the fabric in the machine. The capacity of the conventional circular weaving machine is thus limited by the fact that an equal number of lever arms and shedding arms must be used. The number of arms and rods can only be increased with difficulty. The lever arms move with a pivotal action and must be made sufficiently strong. They must also be made longer when larger circular fabrics are to be woven. The lever arms must be made strong to avoid fatigue and fractures in the material.

It is according difficult to enlarge the diameter of a circular fabric to be woven by a conventional circular weaving machine.

SUMMARY OF THE INVENTION

It is an object of the present invention to provide a shedding device for a circular weaving machine which utilizes a grooved cam that rotates in a periodic motion to drive a cam follower support in a horizontal direction, the horizontal movement being transferred to the vertical movement of shedding rods through a control rod and crank arrangement.

According to the invention, fewer connecting structures are necessary between the cam and the shedding rods. The connection is also simpler so that the circular weaving machine can be modified for weaving larger and smaller diameter fabrics.

A further object of the invention is to provide a shedding device for moving the shedding rods of a circular weaving machine having a rest base on which the shedding rods are mounted for vertical movement, and which comprises a cam mounted for rotation about a vertical axis and having a cam path lying in a horizontal plane. A cam follower support rides in the cam path and carries a pair of control rods extending outwardly from the cam. A cantilever arm is rotably mounted on the rest base and pivotally connected to the cam follower support for holding the cam follower support in a selected rotational position with respect to the cam. The cantilever arm also follows the horizontal movement of the cam follower support.

Cranks are pivotally mounted to the rest base and have arms connected to outer ends of the control rods. Each crank, in turn, has a pair of arms connected to a pair of shedding rods. The two control rods thus control the reciprocating vertical movement of four shedding rods.

A further object of the present invention is to provide shedding device for moving shedding rods of a circular weaving machine which is simple in design, rugged in construction and economical to manufacture.

The aforementioned objects and other objects of the present invention will become apparent with reference to the following description taken in conjunction with the attached drawings wherein similar reference numerals are utilized to designate the same or similar elements.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 2:
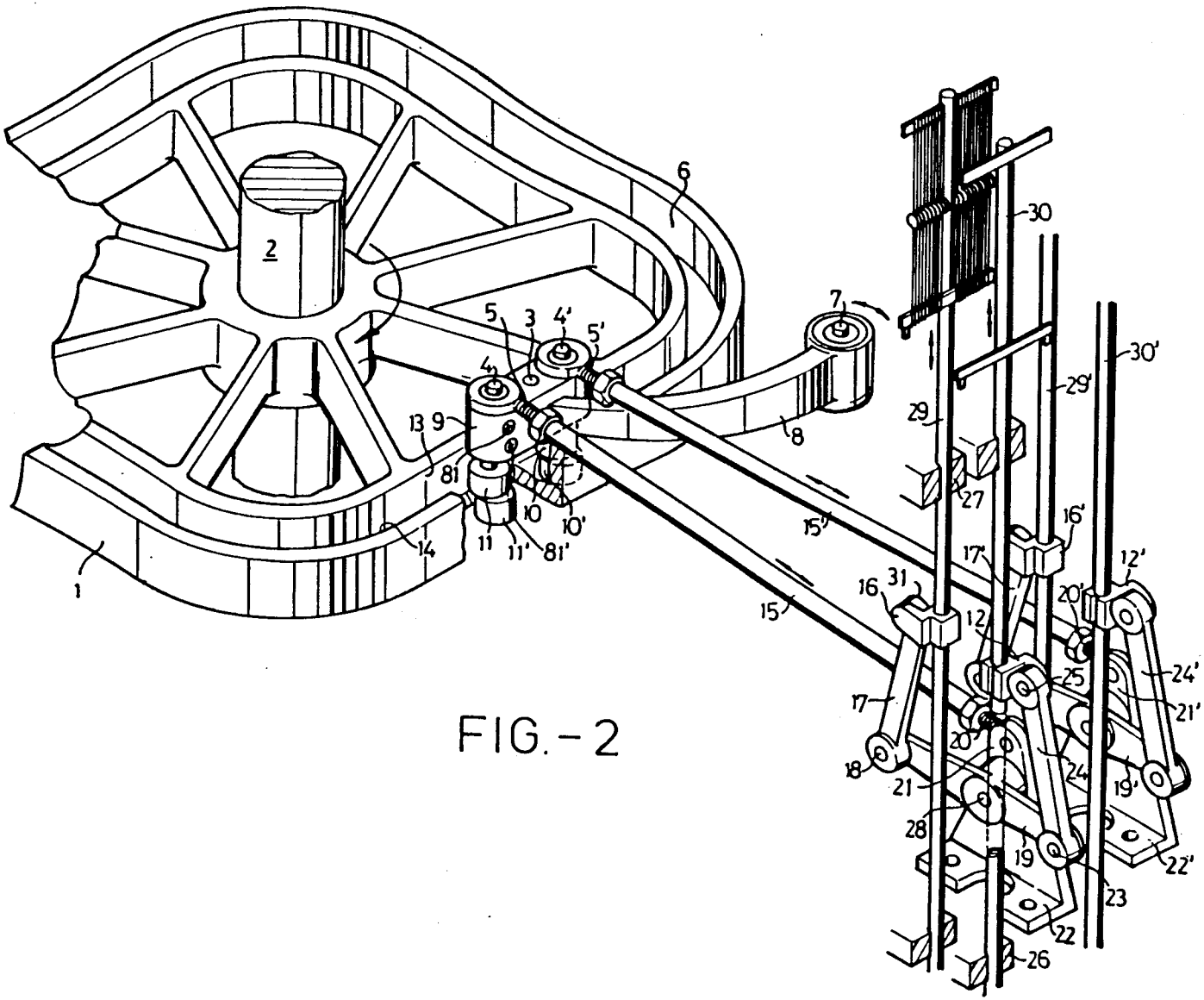
FIG. 2 is a top perspective view of the improved shedding device of the present invention.

Referring now to FIG. 2, the shedding device of the present invention is shown on an enlarged scale and in simplified form. The shedding device comprises a drive shaft 2 mounted for rotation about a vertical axis. A motor (not shown) is connected to shaft 2 for rotating the shaft in the direction of the curved arrow. A cam 1 is fixed to shaft 2 and defines a groove or cam path 6 which lies in a substantially horizontal plane. A motion curve of cam path 6 is designed for the shedding timing of vertical yarns in the circular weaving machine. Cam path 6 is designed to be large enough to accommodate an appropriate number of a cam follower support 9, one of which is shown in FIG. 2. Cam follower support 9 has a substantially rectangular block shape with two circular sides. A pair of cam follower shafts 4, 4' extend through the support 9. Each follower shaft 4, 4' is fixed to the support by set screws 81 and 81'. Shafts 4 and 4' are provided near the opposite rounded sides of the rectangular block shape for support 9. Support 9 also includes a rectangular opening on its outer surface which receives the outer free end of a cantilever arm 8. Cantilever arm 8, which has a rectangular cross section and a curved beam from, is pivotally mounted to a rest base of the machine at a pivot bolt 7. Cantilever arm 8 can thus rock in a horizontal plane responsive to the movements of support 9. For this purpose, the outer free end of arm 8 is pivotally mounted to support 9 by a pivot bolt 3. Pivot bolt 3 is positioned at a rocking center for support 9. Since support 9 is fixed with respect to the rotating cam 1, arm 8 holds the support 9 in a correct angular or rotational position with respect to the cam.

Upper rollers 10 and 11 are connected respectively to follower shafts 4 and 4'. Additional follower shafts are fixed to support 10 which carry follower rollers 10' an 11'. The rollers 10, 10' 11 and 11' are distributed at the ends of support 9 so that they roll against inner surface 13 and outer surface 14 of cam path 6. In this way cam follower support 9 accurately follows the changing position of cam groove 6 as cam 1 rotates.

A cantilever arm 8 is provided for each support 9 and an appropriate number of supports 9 are utilized to activate the shedding rods as will be described hereafter.

A main object of the present invention is to improve the shedding device for fabrics having large diameter. When cam 1 and its cam path or groove 6 rotate, follower support 9 slides and cantilevers in appropriate movements which depend on the shape of the groove 6.

The inner and outer surfaces 13, 14 of cam groove or path 6 are selected to induce the correct motion of the upper and lower rollers 10, 10'. The movement of support 9 is also influenced by the swinging cantilever beam 8 and the other upper and lower rollers 11, 11'. The rollers can advantageously be made of hard steel to avoid wearing. Cam 1 can also be made of such steel. The correct shaping of cam path 6 produces the correct periodic curvilinear motion which is necessary for timing the movements of the vertical yarns through the shedding rods.

As cam 1 rotates in the clockwise direction, as shown in FIG. 2, a rocking curvilinear motion is imparted on support 9. This motion is applied to control rods 15 and 15' which are connected to sleeves through threaded connectors 5 and 5' respectively. The sleeves are engaged around upper ends of the follower shafts 4 and 4'. Control rods 15 an 15' are connected by threaded connectors 20 and 20' to the first crank arms 21 and 21' of a pair of cranks which are pivotally mounted at pin connections 28 to the rest bases 22, 22'.

Each of the cranks have a pair of second crank arms 19, 19'. The crank arms 19 of the crank connected to rod 15 have pivot pins 18, 23 which are respectively connected to connecting links 17, 24. In a similar manner, arm 19' of the crank connected to control rod 15' are pivotally connected to links 17' and 24'.

Clamps 12 and 16 are fixedly connected to two shedding rods 30, 29, respectively, which are mounted for sliding up and down movement to a portion of the rest base at 26, 27. A pair of adjacent rods 29', 30' carry clamps 16', 12' respectively.

Links 17, 17' and 24, 24' are respectively connected to clamps 16, 12 and 16', 12'.

Each of the pivot connections has an appropriate coupling to avoid loosening. As cam follower support 9 pivots and rocks in a horizontal plane due to the rotation of cam 1, control rods 15, 15' move horizontally to pivot the cranks which in turn move shedding rods upwardly and downwardly with correct timing for shedding vertical yarns of the circular weaving machine. In this way, a single support 9 can control four shedding rods. This saves substantial space and permits the use of a larger number of shedding rods and thus the weaving of a larger circular fabric.

Support 9 rotates about bolt 3 which acts as its center of rotation. Bolt 3 also moves horizontally toward and away from the shedding rods which produces a pushing and pulling action the control rods 15, 15'. The pushing and pulling of control rods 15, 15' causes rotation of the cranks which in turn causes vertical pivotal movement of the links 17, 17', 24, 24'.

The shedding device of the present invention has many advantages.

For example, when cam 1 rotates, the amount of friction generated between cam paths 6 and the follower means in the form of roller 10, 11, 10', 11' is not exceedingly high. The impact load on the follower means is also satisfactory and the mechanism of power transmission is very smooth without interferring. The circular weaving machine can thus operate for long period of time without readjustment or repair.

The cam 101 of a convention circular weaving machine rotates in order to transmit power to the shedding rods which move in an up and down motion. The friction and impact load of the prior art cam is not satisfactory and the machine cannot operate for long periods of time as with the invention.

Figure 1:
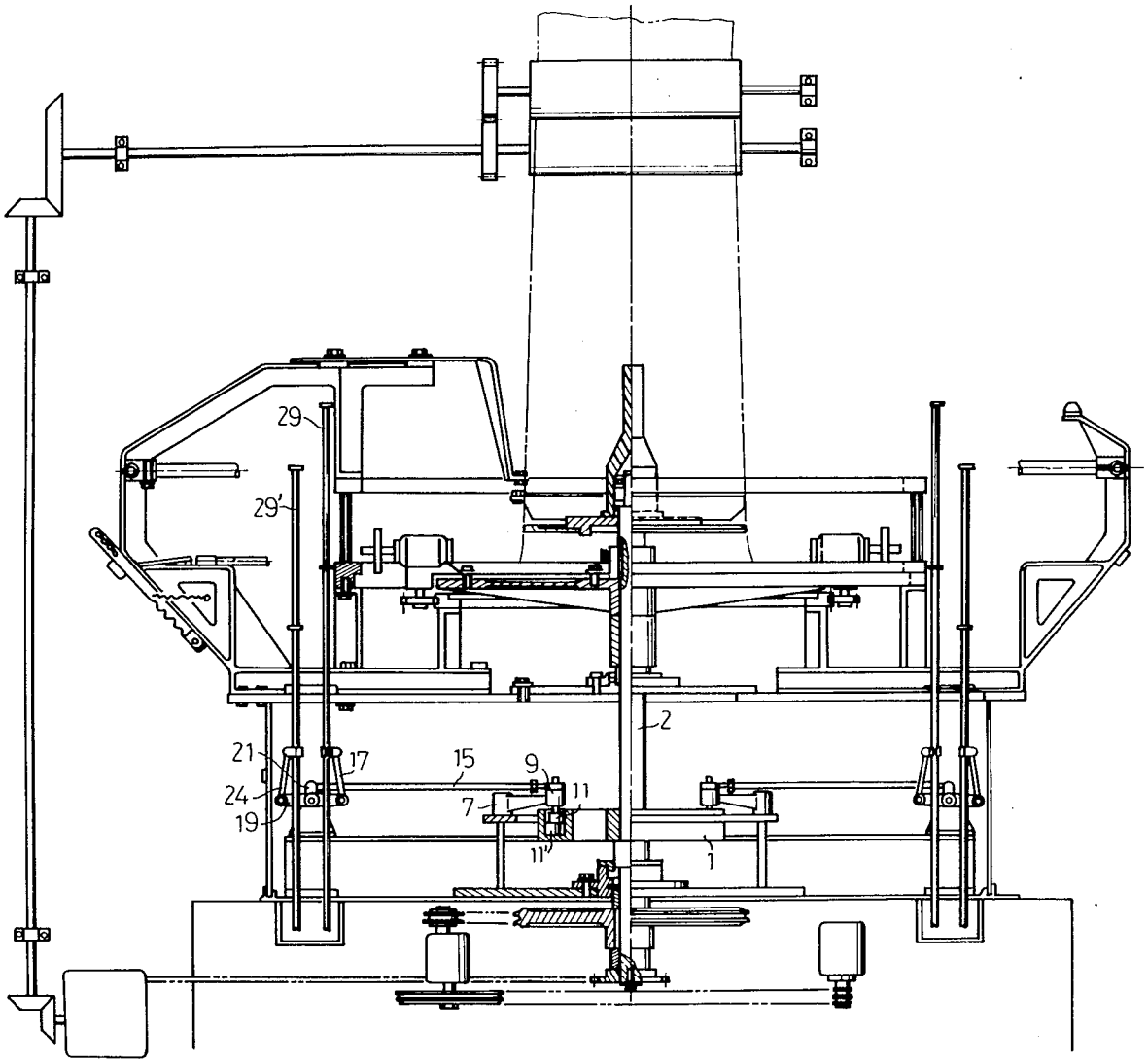
FIG. 1 is a side elevational view, partly in section, of a circular weaving machine embodying the invention.

In addition, control rods 15, 15' move in a reciprocating horizontal direction. The lever arms 103 of a conventional circular weaving machine as shown in FIG. 1 must transmit power directly to the shedding rods. The lever arms must also be long. For this reason they must be made strong and large to withstand the bending forces applied to them. The control rods 15, 15' can be made smaller and less strong since they are only subjected to tensions and compression and to bending forces. The fact that they move in a horizontal plane also saves vertical space which is not the case with the pivotally mounted lever arms 103.

By using cranks and connecting links in the vicinity of the shedding rods, relatively little motion is necessary for the cam follower support 9 as it is moved by the cam path 6. Even with this small amount of horizontal movement, satisfactroy vertical lifting and dropping of the shedding rods is possible.

Also, a single cam follower support 9 can service a pair of control rods 15, 15' which, in turn, can service four shedding rods 29, 30, 29', 30'. This permits the weaving of large diameter fabrics because a large number of shedding arms can be serviced by a relatively small number of follower supports.

The connecting mechanism between the cam and the shedding rods in the conventional circular weaving machine of FIG. 1 requires a single lever arm 103 for each shedding rod 104. It is not, therefore, easy to enlarge the number of shedding rods since the amount of space around cam 101 is limited and cannot accommodate an overly large amount of lever arms 103. There are also limits on the length of the lever arms since if they become too long their structure must be so large that it will not be readily accommodated within the circular weaving machine. Accordingly, the diameter of fabric which can be woven by conventional circular weaving machines is limited to relatively small diameter fabrics.

While a specific embodiment of the invention has been shown and described in detail to illustrate the application of the principals of the invention, it will be understood that the invention may be embodied otherwise without departing from such principals.

What is claimed is:

1. A shedding device for moving shedding rods of a circular weaving machine having a rest base, the shedding rods being for moving vertical yarns and being mounted for vertical movement to the rest base, the shedding device comprising:

a drive shaft mounted for rotation about a vertical axis;

a cam fixed to said drive shaft for rotation therewith and carrying a cam path lying in a horizontal plane;

a cam follower support;

a cam follower means connected to said follower support and engaged in said cam path for moving said cam follower support in a horizontal plane when said drive shaft is rotated;

a cantilever arm mounted to the rest base for rotation about a vertical axis for rocking in a horizontal plane, said cantiliever arm having an outer end pivotally connected to said cam follower support for holding said support at a fixed rotational position with respect to said cam;

a pair of control rods each having one end connected to said support and each having an opposite end; a pair of cranks pivotally connected to the rest base, each crank having a first arm connected to said opposite end of one control rod, each crank having a pair of second arms;

a clamp connected to each shedding rod;

a link pivotally connected to each second arm of each crank; each link being pivotally connected to one of said clamps so that, with rotation of said cam, said support and control rods move horizontally to pivot said cranks and move the shedding rods up and down; and wherein said follower means comprise a first cam follower at one end of said support and a second cam follower at an opposite end of said support, each cam follower comprising a roller engaged with said cam path, one control rod being pivotally connected to said support adjacent one of said followers and the other control rod being pivotally connected to said support adjacent the other of said followers, said free end of said cantilever arm being pivotally mounted to said support between said cam followers whereby said support rotates about the pivotal connection between said cantilever arm and said support and moves horizontally with vertical swinging of said cantilever arm as said cam rotates.

2. A shedding device for moving shedding rods of a circular weaving machine having a rest base, the shedding rods being for moving vertical yarns and being mounted for vertical movement to the rest base, the shedding device comprising:

a drive shaft mounted for rotation about a vertical axis;

a cam fixed to said drive shaft for rotation therewith and carrying a cam path lying in a horizontal plane;

a cam follower support;

a cam follower means connected to said follower support and engaged in said cam path for moving said cam follower support in a horizontal plane when said drive shaft is rotated;

a cantilever arm mounted to the rest base for rotation about a vertical axis for rocking in a horizontal plane, said cantilever arm having an outer end pivotally connected to said cam follower support for holding said support at a fixed rotational position with respect to said cam;

a pair of control rods each having one end connected to said support and each having an opposite end;

a pair of cranks pivotally connected to the rest base, each crank having a first arm connected to said opposite end of one control rod, each crank having a pair of second arms;

a clamp connected to each shedding rod;

a link pivotally connected to each second arm of each crank, each link being pivotally connected to one of said clamps so that, with rotation of said cam, said support and control rods move horizontally to pivot said cranks and move the shedding rods up and down; and wherein said support has an outer vertical side with an opening therein, said free end of said cantilever arm extending into said opening and a bolt connected between said support and said cantilever arm for pivotally connected said support to said cantilever arm.

3. A shedding device for moving shedding rods of a circular weaving machine having a rest base, the shedding rods being for moving vertical yarns and being mounted for vertical movement to the rest base, the shedding device comprising:

a drive shaft mounted for rotation about a vertical axis;

a cam fixed to said drive shaft for rotation therewith and carrying a cam path lying in a horizontal plane;

a cam follower support;

a cam follower means connected to said follower support and engaged in said cam path for moving said cam follower support in a horizontal plane when said drive shaft is rotated;

a cantilever arm mounted to the rest base for rotation about a vertical axis for rocking in a horizontal plane, said cantilever arm having an outer end pivotally connected to said cam follower support for holding said support at a fixed rotational position with respect to said cam;

a pair of control rods each having one end connected to said support and each having an opposite end;

a pair of cranks pivotally connected to the rest base, each having a first arm connected to said opposite end of one control rod, each crank having a pair of second arms;

a clamp connected to each shedding rod;

a link pivotally connected to each second arm of each crank, each link being pivotally connected to one of said clamps so that, with rotation of said cam, said support and control rods move horizontally to pivot said cranks and move the shedding rods up and down; and at least two spaced apart follower shafts connected to said support and a roller connected to each follower shaft, said follower shafts and rollers forming said follower means, said rollers being rollably engaged in said cam path.

4. A shedding device according to claim 3 wherein said cam path comprises a cam groove having an inner surface and an outer surface, said follower means comprising additional rollers rotatably connected to opposite sides of said support, said first-mentioned rollers rolling against an inner surface of said cam groove and additinal rollers rolling against an outer surface of said cam groove.

5. A shedding device according to claim 4 wherein said first-mentioned rollers comprise upper rollers and said additional rollers comprise lower rollers at a different vertical level than first-mentioned rollers.

6. A shedding device according to claim 3 wherein said free end of said cantilever arm is pivotally mounted to said support between said roller shafts.

* * * * *